United States Patent [19]

Takafuji

[11] Patent Number: 4,684,293

[45] Date of Patent: Aug. 4, 1987

[54] CABLE FOR FASTENING STRUCTURES AND METHOD OF DETECTING DAMAGE TO CORROSION-PREVENTIVE LAYER THEREOF

[75] Inventor: Hideo Takafuji, Kawasaki, Japan

[73] Assignee: Nippon Steel Corporation, Tokyo, Japan

[21] Appl. No.: 793,688

[22] Filed: Oct. 31, 1985

Related U.S. Application Data

[63] Continuation-in-part of Ser. No. 592,335, Mar. 21, 1984.

[30] Foreign Application Priority Data

Mar. 23, 1983 [JP] Japan ..... 58-47157
Mar. 23, 1983 [JP] Japan ..... 58-47158

[51] Int. Cl.[4] ..... E02D 5/74

[52] U.S. Cl. ..... 405/224; 324/65 R; 405/195

[58] Field of Search ..... 405/224, 225, 195; 324/65 R

[56] References Cited

U.S. PATENT DOCUMENTS 3,358,229 12/1967 Collins ..... 324/65 R
3,382,493 5/1968 Loper et al. ..... 324/65 R X
3,721,898 3/1973 Dragoumis et al. ..... 324/65 R
3,721,970 3/1973 Niemoth ..... 324/65 R X
4,285,615 8/1981 Radd ..... 405/224 X
4,301,399 11/1981 Miller et al. ..... 324/51
4,404,516 9/1983 Johnson ..... 324/65 R X

*Primary Examiner*—Dennis L. Taylor
*Attorney, Agent, or Firm*—Wenderoth, Lind & Ponack

[57] ABSTRACT

A structure fastening cable has a strand of a large number of metal element wires and a corrosion-preventive layer. The cable also has a cylindrical conductive resistance detector that extends inside and over the entire length of the cable in such a manner as to surround the strand with an insulating layer in between and a device to measure the resistance of a circuit composed of the strand, resistance detector and insulating layer. The resistance detector consists of a cylinder element of metal sheet or spirally wound metal ribbon. The measuring device is inserted in a circuit that connects an end of the strand to an end of the resistance detector at one end of the cable. When the corrosion-preventive layer breaks, seawater enters the reaches the peripheral surface of the strand to establish an electrical connection between the strand and resistance detector via the penetrated seawater, with a resulting sharp reduction in the resistance between the strand and resistance detector. This drop in resistance indicates the presence of a damage in the corrosion-preventive layer, and the amount of a change in resistance indicates the size of the damaged area.

5 Claims, 5 Drawing Figures

CABLE FOR FASTENING STRUCTURES AND METHOD OF DETECTING DAMAGE TO CORROSION-PREVENTIVE LAYER THEREOF

This application is a continuation-in-part application of Ser. No. 592,335, filed Mar. 21, 1984.

BACKGROUND OF THE INVENTION

1. Field of the Invention

This invention relates to a cable for fastening structures, more particularly a cable for mooring offshore floating structures, suspending bridges and supporting buildings, and to a method of detecting damage to the corrosion-preventive layer thereof.

2. Description of the Prior Art

For, example, the mooring means for fastening offshore floating structures employed in the exploration of submarine oil fields etc. are required to have high enough durability to remain in service for as long a period as 20–30 years. Accordingly, steel chains are used extensively in this application.

On the other hand, parallel-wire cables used with suspension bridges and other ground structures are counted among the most excellent tensile structural members on account of their high breaking and fatigue strength and large modulus of elasticity. The parallel-wire cables may be used for mooring offshore structures, but then they must be covered with polyethylene or other suitable material to keep them out of contact with seawater so that their excellent properties mentioned before may be maintained over a long period of time. Namely, preliminary provision of a protective or corrosion-preventing coating or film is indispensable.

When such preliminarily coated parallel-wire cables are used for mooring, it is necessary to check from time to time to determine if their properties remain unchanged. The key point of the check is the presence of damage to the corrosion-preventive layer. If the corrosion-preventive layer is damaged, seawater might penetrate inside and contact the cable, with the result that the cable might get corroded and broken after a while.

The same can be said of the wire ropes consisting of a plurality of strands and covered with a corrosion-preventive layer.

SUMMARY OF THE INVENTION

An object of this invention is to provide a cable for fastening structures equipped with means for detecting the penetration of seawater through a damaged portion of the corrosion-preventive layer and the contact thereof with the cable inside.

Another object of this invention is to provide a cable for fastening structures that permits detecting the position and magnitude of a damage to the corrosion-preventive layer thereof.

A cable for fastening structures according to this invention comprises a strand of element metal wires and a corrosion-preventive layer covering the peripheral surface of the strand. The cable is also provided with a cylindrical conductive resistance detector extending throughout the entire length of the cable in such a manner as to surround the strand with an insulating layer therebetween and a device for measuring the resistance of a circuit composed of the strand, resistance detector and insulating layer, the resistance measuring device being inserted within a circuit that connects an end of the strand to an end of the resistance detector at one end of the cable. The resistance detector may consist of a cylinder element made of metal sheet or spirally wound metal ribbon.

When the corrosion-preventive layer breaks to any significant degree, seawater might penetrate to bring the strand and resistance detector into electrical contact with each other. The result is a sharp reduction in the resistance between the strand and resistance detector, which serves as an indicator of the presence of damage to the corrosion-preventive layer. The amount of change in the resistance shows the cross-sectional area of the damaged portion.

If the presence of damage to the corrosion-preventive layer of the fastening cable in service is detected, the position and magnitude of the damage can be grasped quickly and exactly, whereby repairs, replacement or other accident-preventive measures can be taken without delay. Inspection is possible not only in service but also during manufacturing and after use.

The soundness of the corrosion-preventive layer decisively governs the performance of precoated cables. The cable of this invention which assures exact detection of damage to the corrosion-preventive layer constitutes a great contribution to the safety of structures.

DESCRIPTION OF THE PREFERRED EMBODIMENTS

Figures 1, 2:
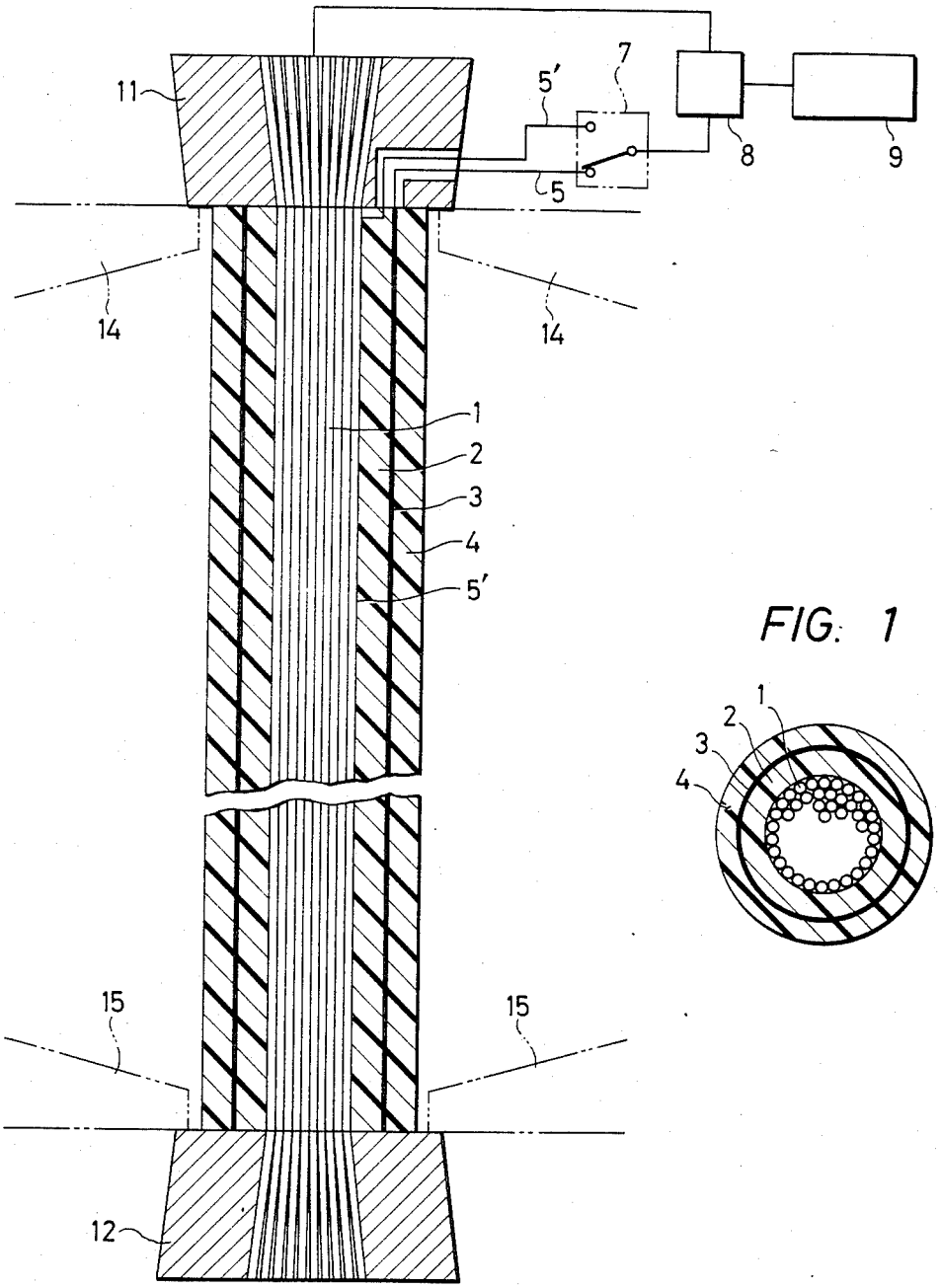
FIG. 1 is a cross-sectional view of an example of cable embodying the principle of this invention.
FIG. 2 is a partially cross-sectional side elevation of the same cable in service.

FIG. 1 shows a transverse cross section of a cable according to this invention which comprises a strand 1 of parallel-laid element wires that is placed at the innermost core and surrounded by a corrosion-preventive layer 2 of a plastic material such as polyethylene, a resistance detector 3 of lead, aluminum or other similar material, and another corrosion-preventive layer 4 of the same material as said corrosion-preventive layer 2 that are concentrically disposed in that order.

As shown in a partially cross-sectional side elevation in FIG. 2, an upper socket 11 and a lower socket 12 attached to both ends of a cable according to this invention are fastened to an upper socket support 14 and a lower socket support 15, respectively.

To make the tension working on each wire uniform, the strand 1 is cast in a loosened state in the sockets 11 and 12 using a coupling alloy. Since no other surface coating than the usual metallic one is given to the element wires, all the wires of the strand 1 are electrically in a totally conductive, short-circuited state.

The resistance detector 3 performs two functions; i.e., to detect the penetration of seawater, that is, the purpose of this invention and, at the same time, to prevent the penetration of seawater and the damage caused by external forces. The resistance detector extends over the entire length of the cable, electrically insulated from the strand 1. A switch 7 and an electric resistance meter 8 are electrically connected between the strand 1 and the upper end of the resistance detector 3 and also between the strand 1 and the lower end of the resistance detector 3. Reference numerals 5 and 5' designate lead wires connecting the resistance detector 3 to the switch 7. An arithmetic indicator 9 is linked to the electric resistance meter 8.

An offshore floating structure can be moored by use of a cable according to this invention, with the lower socket 12 thereof fastened to the lower socket support 15 placed at the sea bottom and the upper socket 11 to the upper socket support 14 attached to the floating structure. When the corrosion-preventive layers 2 and 4 are broken to allow seawater to penetrate inside and come in contact with the strand 1, the value of resistance between the strand 1 and the resistance detector 3 changes to indicate that something has gone wrong with the strand.

Without damage, the electric resistance $R_o$ between the strand 1 and the resistance detector 3 can be approximated as $$R_o=\rho_o\cdot(d/A) \quad (1)$$

where $\rho_o$ is the specific resistance of the corrosion-preventive layer 2, d and A are the thickness in the direction of radius and the average area of the surface of the core strand 1 and the surface of the resistance detector 3 respecitively.

Figure 4:
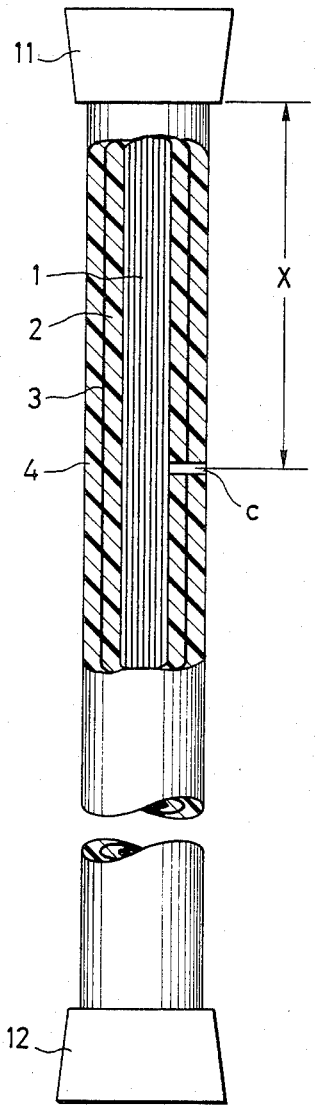
FIG. 4 is a longitudinal cross-sectional view of the same damaged corrosion-preventive layer.
Figure 3:
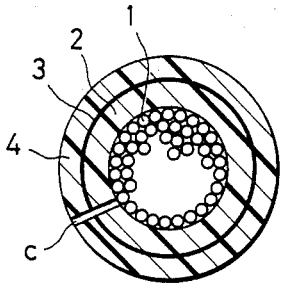
FIG. 3 is a transverse cross-sectional view showing a damaged corrosion-preventive layer.
Figure 5:
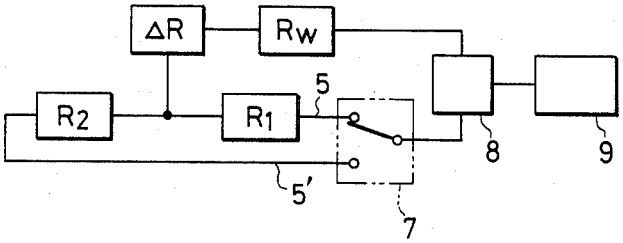
FIG. 5 shows an equivalent circuit indicating the condition of the measuring system when the corrosion-preventive layer is damaged.

When a crack C reaching from the surface of the cable to the periphery of the strand develops, as shown in FIGS. 3 and 4 to allow the penetration of seawater, electric resistance R changes as follows:

FIG. 5 shows an equivalent circuit showing the condition in this case. $R_1$ indicates the electric resistance offered by the resistance detector 3 between the upper end of the cable and the crack C, $R_2$ the electric resistance offered by the resistance detector 3 between the lower end of the cable and the crack C, $R_W$ the electric resistance offered by the strand 1 between the upper socket 11 and the crack C, and $\Delta R$ the electric resistance offered by the crack C. Here, the electric resistance $\Delta R$ is expressed by the following expression.

$$\Delta R=\rho(d/S) \quad (2)$$

where $\rho$ is the specific resistance of seawater and S is the mean cross-sectional area of the crack.

In the condition shown in FIG. 5, strictly speaking, the electric resistance $R_o$ offered by the corrosion-preventive layer is presented, in parallel, to the electric resistance meter (not shown). But this resistance is negligible because it is much larger than $R_1$, $R_2$, $\Delta R$ and $R_W$.

Accordingly, the resistance R that is determined by the electric resistance meter 8 when the switch 7 is connected to the upper-end side of the resistance detector 3 (the condition illustrated) is as follows ($R_W$ is omitted because it is smaller than $R_1$ and $\Delta R$):

$$R=R_1\Delta R \quad (3)$$

The resistance R' that is determined by the electric resistance meter 8 when the switch 7 is connected to the lower-end side of the resistance detector 3 is as follows:

$$R'=R_2+\Delta R \quad (4)$$

By adding together the measured resistances R and R' using the arithmetic indicator 9, the following is obtained:

$$R_A|R+R'=R_1+R_2+2\Delta R \quad (5)$$

From equations (2) and (5), the cross-sectional area S of the crack C is derived from the following equation.

$$S=2\rho d/\{R_A-(R_1+R_2)\} \quad (6)$$

In the above equation, $R_1+R_2$ is the electric resistance offered by the resistance detector 3 over the entire length of the cable which can be determined previously. Therefore, the penetrating condition of seawater and the damage caused to the corrosionpreventive layer can be quantified.

The following equation is derived by a subtracting R' from R using the arithmetic indicator 9.

$$R_B=R-R'=R_1-R_2 \quad (7)$$

Meanwhile, the point X at which seawater penetrates is expressed as follows by assuming that the resistance offered by the resistance detector per unit length of the cable is r:

$$X=R_1/r \quad (8)$$

Therefore, from equations (7) and (8), $$X=(R_B+R_1+R_2)/2r \quad (9)$$

Since $R_1+R_2$ is already known and $r=(R_1+R_2)/L$ wherein L is the overall length of the cable, the point X at which seawater penetrates is derived from equation (9).

An example in which this invention was applied is described in the following.

The cable used was of the structure shown in FIG. 1. The diameter of the strand was 160 mm and that of the resistance detector was 180 mm. The overall length of the cable was 500 m. The corrosion-preventive layer was of high-density polyethylene. The resistance detector was made up of a laminated lead tape, 50 $\mu$m in thickness and 60 mm in width, coated with a hot-melt type resinous adhesive and wrapped in a half-wrap fashion. The electric resistance over the entire length of the resistance detector was approximately 658 $\Omega$ and the resistance per meter of the cable was 1.32 $\Omega$.

Before being put to use, the cable had an interlayer resistance of over 1000 M$\Omega$. But when seawater penetrated through a crack, about 1 $mm^2$ in cross-sectional area, 100 m away from the upper end of the cable to the crack, the interlayer resistance dropped substantially to approximately 2480 $\Omega$ between the upper end of the resistance detector and the strand and approximately 2870 $\Omega$ between the lower end of the resistance detector and the strand. The penetration of seawater was clearly detected. On performing calculations (6) and (9) on the basis of the determined resistance values, the arithmetic indicator indicated that the size of the crack S was 0.98 $mm^2$ and the position of the crack X was 101.5 m away from the upper end.

When any damage is caused to the corrosion-preventive layer in service, the damage detecting method according to this invention permits quickly and accurately determining the position and magnitude of the damage, taking necessary corrective measures such as repairing the replacing, and preventing the occurrence of serious troubles.

Of course, this invention is applicable not only to parallel-wire cables but also to other types of cables. The cables according to this invention are also applicable not only to floating structures but also to pipes, columns, suspension bridges and other structures that are fastened with cables. The cables according to this invention can be used not only under the sea but also in fresh water and even in the atmosphere where there is a likelihood of water penetrating the corrosion-preventive layer thereof.

What is claimed is:

1. A cable for fastening structures, which comprises:

a strand made up of a large number of element wires;

a corrosion-preventive layer surrounding the peripheral surface of the strand;

a cylindrical conductive resistance detector extending inside and over the entire length of the cable in a manner to surround said strand;

an electrically insulating layer between said resistance detector and said strand;

means for measuring resistance having: a means for forming a first resistance circuit through said resistance detector from one end thereof, a rupture through said insulating layer to said strand, and said strand and which has a first resistance which includes the resistance between the one end of said detector and the location of the rupture and the resistance at the ruptured point to the strand connected in series, and for forming a second resistance circuit through said resistance detector from the other end thereof, the rupture and said strand and which has a second resistance which includes the resistance between the other end of said detector and the location of the rupture and the resistance at the ruptured point to the strand connected in series, and a current flow measuring means for measuring current flow in said two resistance circuits; and an arithmetic unit connected to said resistance measuring means for determining the position and magnitude of the rupture from a comparison of the first and second resistances and the resistance of the entire length of said resistance detector.

2. A cable according to claim 1 wherein said corrosion-preventive layer has said resistance detector therewithin and said insulating layer is the portion of said corrosion-preventive layer between said resistance detector and said strand.

3. A cable according to claim 1 wherein said resistance detector consists of a cylindrical metal sheet.

4. A cable according to claim 1 wherein said resistance detector consists of a cylindrical spirally wound metal ribbon.

5. A method for detecting damage to a cable for fastening structures, which cable has a strand made up of a large number of element wires, a corrosion-preventive layer surrounding the peripheral surface of the strand, a cylindrical conductive resistance detector extending inside and over the entire length of the cable in a manner to surround said strand, and an electrically insulating layer between said resistance detector and said strand, said method comprising:

determining a first resistance through said resistance detector from one end thereof to a rupture through said insulating layer to said strand and the resistance at the ruptured point to the strand connected in series, and determining a second resistance through said resistance detector from the other end thereof to the rupture and the resistance at the ruptured point to the strand connected in series; and determining the cross-sectional area of the rupture from the sum of the first and second resistances and the resistance of the entire length of said resistance detector, and determining the position of the rupture in the corrosion-preventive layer from the difference between the first and second resistances and the resistance of the entire length of said resistance detector.

* * * * *